US007725981B2

(12) United States Patent
Moskovich et al.

(10) Patent No.: US 7,725,981 B2
(45) Date of Patent: Jun. 1, 2010

(54) TOOTHBRUSH

(75) Inventors: Robert Moskovich, East Brunswick, NJ (US); Tanja Langgner, London (GB); Joachim Storz, Zell am See (AT); Thomas Kūchler, Schliern (AT)

(73) Assignee: Colgate-Palmolive Company, New York, NY (US)

( * ) Notice: Subject to any disclaimer, the term of this patent is extended or adjusted under 35 U.S.C. 154(b) by 781 days.

(21) Appl. No.: 11/053,589

(22) Filed: Feb. 8, 2005

(65) Prior Publication Data

US 2005/0193512 A1 Sep. 8, 2005

Related U.S. Application Data

(63) Continuation of application No. PCT/US03/24879, filed on Aug. 8, 2003.

(60) Provisional application No. 60/402,165, filed on Aug. 9, 2002.

(51) Int. Cl.
*A46B 9/04* (2006.01)

(52) U.S. Cl. ..... 15/167.1; 15/201

(58) Field of Classification Search ..... 15/167.1, 15/110, 201

See application file for complete search history.

(56) References Cited

U.S. PATENT DOCUMENTS 2,129,082 A 9/1938 Byrer
2,164,219 A 6/1939 McGerry
3,129,449 A 4/1964 Bernard
5,120,225 A 6/1992 Amit
5,184,368 A 2/1993 Holland
5,269,038 A 12/1993 Bradley
5,524,319 A 6/1996 Avidor
5,802,656 A * 9/1998 Dawson et al. ..... 15/110
5,813,079 A 9/1998 Halm
5,970,564 A * 10/1999 Inns et al. ..... 15/201
5,991,959 A * 11/1999 Raven et al. ..... 15/201
6,505,373 B2 * 1/2003 van Gelder et al. ..... 15/167.1

FOREIGN PATENT DOCUMENTS

CN 1150748 A 5/1997
CN 1207655 A 2/1999
DE 41 22 524 A1 2/1992
RU 2 039 518 C1 7/1995

* cited by examiner

*Primary Examiner*—Randall Chin
(74) *Attorney, Agent, or Firm*—Amy M. Fernandez

(57) ABSTRACT

A toothbrush head is provided with a plurality of separate cleaning areas. The distal end and the proximal end of the head include cleaning elements mounted to generally non-movable bases. The central portion of the head includes resilient pods carrying cleaning elements in such a manner that the cleaning elements are capable of bending away from their initial position and then returning to their initial position. In another aspect of the invention the pods are made as a separate unitary subassembly wherein the cleaning elements are bristles in an IMT procedure. The unitary subassembly is secured to the remainder of the cleaning head of the brush during the molding operation of the remainder of the head and the handle. In this aspect of the invention non-movable bases may be provided or may be omitted.

18 Claims, 3 Drawing Sheets

34A
26A
25
38A
23
34A 23
34A
26A
25
38A
34A
14A
10A
12A

TOOTHBRUSH

This application is a continuation of application PCT/US 2003/024879, filed Aug. 8, 2003, which claims the benefit of U.S. Provisional Application 60/402,165 filed Aug. 9, 2002, both of which are incorporated herein by reference in their entirety.

BACKGROUND OF THE INVENTION

The present invention relates to manually held and operated toothbrushes having flexibly mounted bristles. A number of approaches have been taken in the prior art to provide flexibility to the bristles during use of a toothbrush. U.S. Pat. No. 5,970,564, for example, discloses a toothbrush having an elastomeric ridge wherein there is a center array of bristles and there is a side array of bristles mounted in elastomeric boots. A number of patents disclose a toothbrush head having sets of bristles, each of which is mounted to a non-rigid or elastic support element. Examples of these approaches are found in U.S. Pat. Nos. 1,770,195, 2,244,098, 6,161,245 and 6,311,360 and in French Patent No. 38440.

It would be desirable if a toothbrush could be provided having various cleaning elements such as bristles with different degrees of flexible mounting.

SUMMARY OF THE INVENTION

An object of this invention is to provide a toothbrush having the head separated into different cleaning areas which differ from each other in the flexible mounting of the cleaning elements.

A further object of this invention is to provide such a toothbrush wherein some of the cleaning areas have the cleaning elements mounted on a relatively fixed or non-movable base while other cleaning areas are mounted on a flexible or elastic pod.

A still further object of this invention is to provide techniques for improving the manufacturability of toothbrushes such as indicated above or toothbrushes having only flexibly mounted cleaning elements.

In accordance with this invention the toothbrush head is divided into a plurality of separate cleaning areas. These areas include at least one and preferably two areas wherein the cleaning elements are mounted to a base with other areas having the cleaning elements mounted to pods wherein the pods have a greater degree of movability than do the bases. The pods are resilient so that during use the cleaning elements could be moved from their initial position and then returned to the initial position.

The pods may be formed from a narrow or small diameter beam extending from the body of the toothbrush head to a cleaning element support pad. Preferably the small diameter beam is enclosed in elastic material.

In a preferred practice of the invention a relatively non-movable base is located at each of the distal and proximal ends of the toothbrush head with at least two elastic pods mounted between the two bases. These various cleaning areas are separated from each other by channels extending completely across the head in a transverse direction.

In accordance with a further aspect of this invention the pods are formed utilizing an IMT process where the bristles are introduced into the mold cavity into which a plastic material is injected. As the injected material cools off, it permanently traps the bristles to form a brush. In order to achieve functional flexibility and proper tuft retention, materials are used to create a pod of mushroom shape by forming a stem and a plate to which the bristles would be secured. The pods are interconnected at the stems to form a first subassembly for making the toothbrush. This subassembly may then be attached to the bulk of the toothbrush, which includes the remainder of the head and the handle, by being overmolded with an entire toothbrush handle during a second injection cycle. As a result, the entire handle could be formed at normal speeds because the IMT process is initially isolated to a smaller material shot size.

THE DRAWINGS

DETAILED DESCRIPTION

Figures 1, 2, 3, 4:
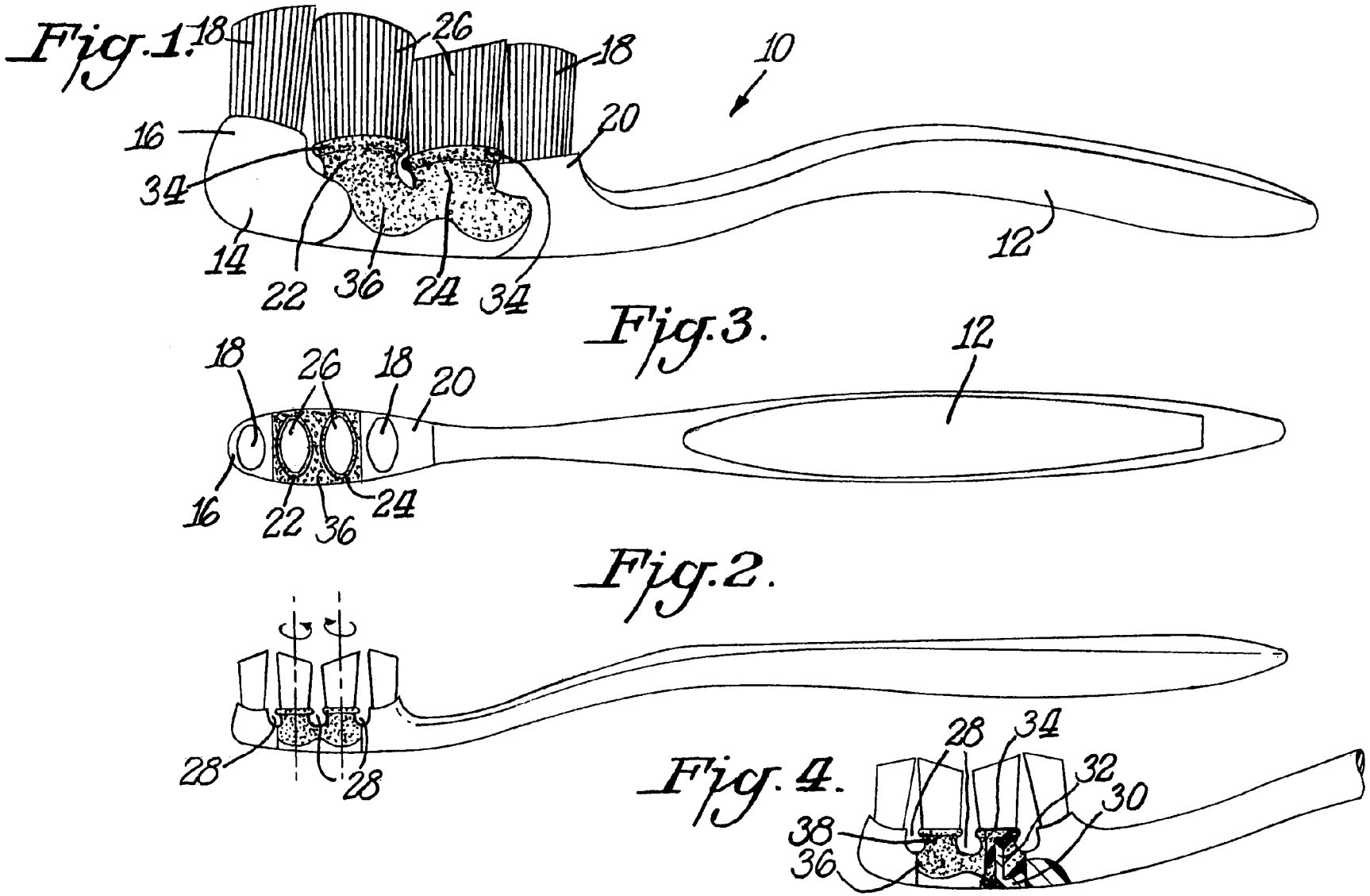
FIG. 1 is a perspective view of a toothbrush in accordance with this invention.
FIG. 2 is a side elevational view of the toothbrush shown in FIG. 1.
FIG. 3 is a front elevational view of the toothbrush shown in FIGS. 1-2.
FIG. 4 is a side elevational view similar to FIG. 2 partially broken away.

FIGS. 1-4 illustrate a toothbrush 10 in accordance with one aspect of this invention. As shown therein toothbrush 10 includes an elongated hand-held handle 12 with a head 14 connected to and extending from the handle. The head 14 is divided into a plurality of separate cleaning areas which are spaced from each other. As illustrated the cleaning areas include a base 16 located at the distal end of the head 14 and projecting outwardly from the main body portion 30 of the head. Base 16 includes at least one and preferably a plurality of cleaning elements 18. Head 14 further includes a base or supporting member 20 at the proximal end of head 14. Cleaning elements 18 also extend outwardly from base 20.

Mounted between the cleaning areas which incorporate bases 16 and 20 are a pair of pods 22,24. Each pod is provided with at least one and preferably a plurality of cleaning elements 26. As later described the pods 22,24 have a greater degree of movability than do the bases 16,20. In the preferred practice of the invention the pods 22,24 are resilient members so that the pod cleaning elements add a motion range beyond the cleaning elements 18 which are generally static or non-movable. Preferably, because the various cleaning elements are separated from each other such as by channels 28 which extend completely across head 14 in a transverse direction and because of the elastic nature of pods 22,24, the cleaning elements 26 are capable of 360 degrees rotation about the vertical axis of each individual pod. The angle of the bend is dictated by the ability of the material to bend.

Toothbrush 10 thus provides a head 14 wherein the front (distal end) and the back (proximal end) areas are in a relatively fixed position and wherein the cleaning elements, such as bristle strands, 18 do not have any extra degree of motion. The middle portion of head 14, however, has two areas of cleaning elements 26,26 which are capable of 360 degree rotation.

As best shown in FIG. 4 the head 14 includes a main body portion 30 which supports the bases and pods. Body portion 30 and bases 16 and 20 are preferably made from conventional hard plastic materials, such as polypropylene, commonly used in the making of toothbrush handles and heads. Pods 22,24, however, are made so as to be resilient. In the preferred practice of this invention, the resiliency of pods 22,24 is achieved by providing a thin diameter beam 32 which extends from the main body portion 30 of the head of the toothbrush. Beam 32 is joined into the bottom of a thin pad or plate 34 which provides a support area onto which the cleaning elements 26 are affixed. The manner of mounting the cleaning elements 26 to the support pads 34 can be achieved utilizing various cleaning elements, such as bristles and other cleaning materials, in known attachment methods.

The desired flexibility or resiliency of the pods 22,24 is enhanced by enclosing the thin beams 32 in elastic material 36 which could be acquired during the multi-injection molding process. The elastic material 36 serves as a rubber band by returning the beams 32 to their original form or initial position. This return action creates an active motion in the opposite direction of the beam bend which aids in the cleaning of teeth by introducing extra brushing strokes.

As best shown in FIGS. 1, 2 and 4 the pods 22,24 include a widened portion disposed toward the body 30. The support pads 34 are also widened. Each pod has a narrow or reduced diameter central portion 38 longitudinally intermediate the length of each pod. Thus, each pod is of generally mushroom shape.

Beam 32 could be of any suitable shape such as having a cross-section which is circular, square or any other geometric shape that provides a thin dimension or thin diameter to the beam to facilitate the bendability of the beam. The elastomer 36 may be considered as a continuous layer of any suitable thickness which covers the entire central area of head 14 as illustrated so that both pods 22,24 are incorporated as part of the same elastic material. The portion of the head 14 which includes pods 22,24 may be formed as a separate subassembly similar to the subassembly later described with respect to FIG. 5-6.

Although the invention could be practiced with a single base and a single pod and could be practiced with the base having some, but a lesser degree of flexibility than the pod, the invention is preferably practiced wherein the base is generally static or non-movable. In addition, the invention is preferably practiced where there are a plurality of such bases and a plurality of pods. The drawings illustrate a preferred practice of the invention where there are a total of four separate cleaning areas with the pods being located in the central portion of head 14. The invention is also preferably practiced where the cleaning elements comprise a plurality of bristles or strands on each base and each pod.

As illustrated in FIG. 3 each base 16 and 20 and each pod 22 and 24 has a generally oval outer surface. The bases and pods are longitudinally aligned, but spaced from each other by the depressions or open areas which form the channels 28. As also illustrated in FIG. 3 the pods have a larger outer surface or cleaning element carrying surface than do the bases.

As shown in FIG. 2 the terminal surfaces of the cleaning elements 18 and 26 are tapered so that the terminal surfaces of the cleaning elements 18 taper outwardly in a direction toward the center of head 14 while the terminal surfaces of cleaning elements 26 taper outwardly in a direction away from the center of head 14. Thus, the highest points of each set of cleaning elements 18 and its adjacent set of cleaning elements 26 are generally disposed toward each other for each pair of base and pod 16,22 and 20,24.

Any suitable form of cleaning elements may be used as the cleaning elements 18 and 26 in the broad practice of this invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

Using different cleaning materials as cleaning elements of the toothbrushes may yield different effects. In an attempt to provide better stain removal a rubber-like material or elastomer can be used in combination with conventional bristles or used by itself to "brighten/whiten" the teeth.

It is to be understood that the specific illustration of the cleaning elements is merely for exemplary purposes. The invention can be practiced with various combinations of the same or different cleaning element configurations (such as stapled or in-molded technology bristles, etc.) and/or with the same bristle or cleaning element materials (such as nylon bristles, spiral bristles, rubber bristles, etc.) Similarly, while FIG. 2 illustrates the cleaning elements to be generally perpendicular to the outer surface of head 14, some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Figures 5, 6:
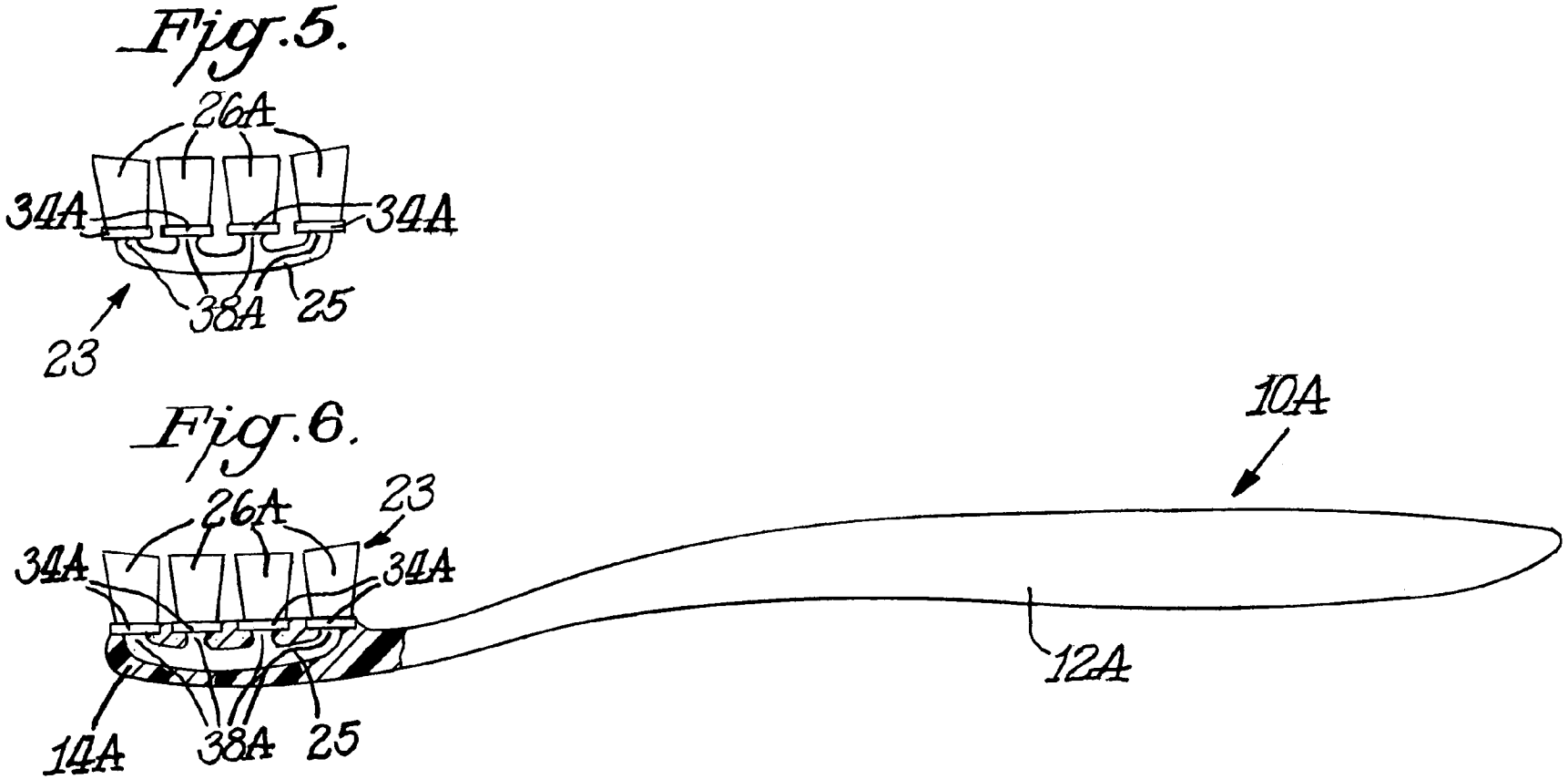
FIG. 5 is a side elevational view showing a subassembly of the bristle containing portion of the brush head in accordance with another aspect of this invention.
FIG. 6 is a side elevational view showing the subassembly of FIG. 5 incorporated in a completed toothbrush.

FIGS. 5-6 illustrate a further aspect of this invention relating to techniques for forming the toothbrush. The toothbrush 10A has the ability to provide flexible support for the bristles 26A in designated areas. The flexibility is provided by designing the tuft holding areas 34A as plates which in combination with the stems 38A forms pods of mushroom shape. The mushroom stem 38A is made flexible to allow the plate 34A populated with bristles or cleaning elements 26A to move in different directions while brushing, as described with respect to the flexible pods of FIGS. 1-4.

FIGS. 5-6 show the toothbrush 10A and in particular the cleaning element or bristle carrying portion 23 of the head 14A to be made utilizing an IMT process. As shown in FIG. 5 the bristle or cleaning element carrying portion 23 forms an initial subassembly. This subassembly is made by introducing the cleaning elements 26A into the mold cavity into which a plastic material is injected. As the material injected cools off it permanently traps the bristles or cleaning elements 26A to form a brush or subassembly 23.

To achieve a functional flexibility and proper tuft retention the portion of the bristle holding part or subassembly 23 which comprises the plates 34A, stems 38A and interconnecting support 25 is preferably a blend of polypropylene (PP) and soft TPE. Once the PP/TPE blend is combined with the bristles 26A the subassembly 23 is formed. In an initial independent IMT step the subassembly 23 is then overmolded with an entire toothbrush handle 12A and head 14A during a second injection cycle to form the completed toothbrush 10A shown in FIG. 6. If desired or required the entire handle 12A and head 14A absent the subassembly 23 could be made first and the subassembly or bristle retaining portion 23 made second.

Other IMT toothbrushes that have bristles attached to the bulk of the handle as known in the prior art are difficult to make because of the slow injection speed needed to fill the head of the toothbrush. The present invention permits the making of an entire handle at normal speeds by isolating the IMT process for making subassembly 23 to the smaller material shot size. Although a blend of PP/TPE is a preferred practice of this invention such blend is not required to make an IMT brush using the method of this invention. Similarly, the invention may be practiced using compatible materials to fuse the first and second shots so that the subassembly 23 created in one of the shots will be secured to the remainder of the toothbrush in the other shot. Thus, the two shots are mechanically trapped together to achieve essentially the same benefits as achieved by combining the subassembly 23 with the remainder of the toothbrush in a second injection cycle.

It is to be understood that the invention described in FIGS. 5-6 could be practiced where all portions of the head 14 include the flexible mushroom sections without having less flexible base portions such as bases 16 and 20 of FIGS. 1-4. Similarly, the subassembly two shot techniques of FIGS. 5-6 could be utilized in the embodiment of FIGS. 1-4 for forming the two or more central pods 22,24 as a single subassembly initially made separate from the remainder of the toothbrush head 14. The final toothbrush would be made in a second injection molding process wherein the subassembly having interconnected pods 22,24 would be molded to the handle 12 and head 14 made of more rigid material.

As noted, FIG. 2 illustrates the terminal surfaces of the cleaning elements 18 and 26 to be tapered in an up and down or zig zag manner. FIGS. 5-6 show an alternative taper wherein the terminal surfaces form a smooth, gentle, concave shape. If desired, other shapes may be used such as a planar shape for the terminal surfaces or a convex shape as well as the zig zag or up and down shape shown in FIG. 2. Similarly, the terminal ends of the cleaning elements in the FIGS. 1-4 embodiment, as well as those of FIGS. 5-6, could have the various shapes such as zig-zag, convex, concave or planar.

Although FIGS. 1-4 and 5-6 illustrate a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 7:
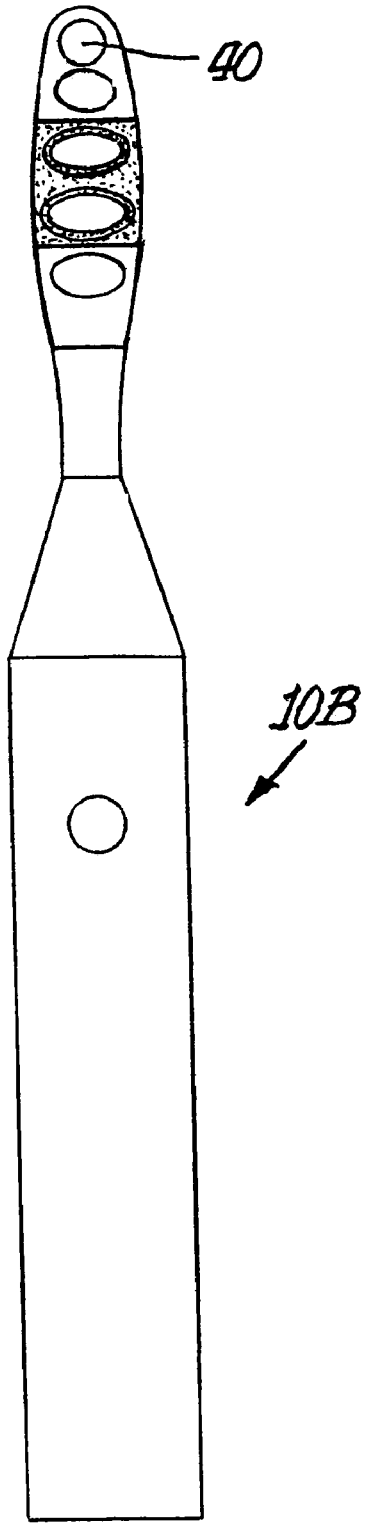
FIG. 7 is a front elevational view of a further toothbrush in accordance with this invention.

FIG. 7 illustrates a toothbrush 10B which includes a power driven movable disc or section 40 having cleaning elements. The movable section 40 could be oscillated rotationally such as by using the type of drive mechanism shown in U.S. Pat. No. 5,625,916, or could move in and out using the type of drive mechanism shown in U.S. Pat. No. Re35,941, all of the details of both patents are incorporated herein by reference thereto. Alternatively, the other types of drives referred to above could move section 40 in other manners and directions. Although FIG. 7 shows movable section 40 to be at the distal end of the head, the movable section(s) could be located at any desired location on the head.

What is claimed is:

1. A toothbrush comprising;

a handle;

a head connected to said handle, said head having a body portion, a longitudinal axis and a plurality of separate cleaning areas located along the longitudinal axis;

wherein a distal-most cleaning area and a proximal-most cleaning area are comprised of fixed bases that are non-movable with respect to the body portion, at least one cleaning element extending outwardly from each of the bases;

at least one of said cleaning areas located between the distal-most and proximal-most cleaning areas comprising a flexible pod that is movable with respect to the body portion, a plurality of bristles extending outwardly from the pod;

wherein the pod is formed by a columnar beam connected to and extending from the body portion of the head along an axis substantially normal to the longitudinal axis, the columnar beam enclosed in an elastic material;

wherein the columnar beam is bendable from an initial position. the elastic material returning the columnar beam to the initial position;

the cleaning areas separated from each other by a channel extending transversely across the head; and wherein the pod terminates in a bristle carrying surface and the bases terminate in cleaning element carrying surfaces, and wherein the bristle carrying surface and the cleaning element carrying surfaces transversely extend the substantial entirety of the width of the head.

2. The toothbrush of claim 1 wherein the bristles of the pod are capable of 360 degrees rotation about the axis that is substantially normal to the longitudinal axis.

3. The toothbrush of claim 1 wherein the pod further comprises a plate, the columnar beam connected to a bottom of the plate, the bristles connected to the plate and extending from a top of the plate.

4. The toothbrush of claim 1 wherein the columnar beam, the bases and the body portion are formed of a hard plastic.

5. The toothbrush of claim 1 further comprising a plurality of the pods located between the distal-most and proximal-most cleaning areas.

6. The toothbrush of claim 1 further comprising two of the pods located between the bases of the distal-most and proximal-most cleaning areas wherein the cleaning elements on the bases have terminal ends which taper outwardly from a longitudinal center of the head, the bristles of the pods having terminal ends which taper toward the longitudinal center of said head, and each adjacent pair of base and pod having the cleaning elements of the bases and the bristles of the pods with the longest portions adjacent to each other.

7. The toothbrush of claim 1 wherein said pod includes an intermediate portion of reduced diameter.

8. The toothbrush of claim 1 wherein the body portion, the bases and the columnar beams are a unitary structure.

9. A toothbrush comprising:

a handle;

a head connected to said handle, said head having a main body portion and a longitudinal axis;

a plurality of bases projecting outward from the main body portion in a first direction, the bases being non-movable with respect to the main body portion;

at least one cleaning element extending from each of the bases in the first direction;

a plurality of columnar beams connected to and projecting outward from the main body portion in the first direction, each of the columnar beams enclosed in an elastic material so as to form a pod that is movable with respect to the main body portion;

a plurality of bristles extending from each of the pods in the first direction; and the pods and the bases located along the longitudinal axis of the head, the pods and the bases spaced apart from one another by a transverse channel so that the pods can move independently of one another and the bases.

10. The toothbrush of claim 9 wherein a first of the bases is located at a distal-most portion of the head and a second of the bases is located at a proximal-most portion of the head, the pods located between the first and second bases.

11. The toothbrush of claim 9 wherein the main body portion, the bases and the columnar beams are formed of a hard plastic.

12. The toothbrush of claim 11 wherein the main body portion, the bases and the columnar beams are a unitary structure.

13. The toothbrush of claim 11 wherein the columnar beams, the bases and the main body portion are formed of a hard plastic, and wherein the columnar beams are bendable from an initial position, the elastic material returning the columnar beam to the initial position.

14. The toothbrush of claim 13 wherein each of the pods further comprise a plate, the beam of each pod connected to a bottom of the plate, the bristles of each pod connected to the plate and extending from a top of the plate.

15. The toothbrush of claim 9 wherein the bristles of the pods are capable of 360 degree rotation about an axis of the columnar beams in the initial position.

16. The toothbrush of claim 9 wherein the pods terminate in bristle carrying surfaces and the bases terminate in cleaning element carrying surfaces, and wherein the bristle carrying surfaces and the cleaning element carrying surfaces transversely extend the substantial entirety of the width of the head.

17. The toothbrush of claim 16 wherein the bristle carrying surfaces and the cleaning element carrying surfaces are oval in shape having a major axis and a minor axis, and wherein the minor axis of the oval shapes are substantially aligned with the longitudinal axis of the head.

18. A toothbrush comprising:

a handle;

a head connected to said handle, said head having a main body portion and a longitudinal axis;

a first base projecting outward from the main body portion in a first direction, the first base being non-movable with respect to the main body portion and located at a distal-most portion of the head, the first base terminating in a first cleaning element carrying surface;

a second base projecting outward from the main body portion in the first direction, the second base being non-movable with respect to the main body portion and located at a proximal-most portion of the head, the first base terminating in a second cleaning element carrying surface;

at least one cleaning element extending from each of the first and second cleaning element carrying surfaces in the first direction;

a plurality of columnar beams connected to and projecting outward from the main body portion in the first direction, the columnar beams located between the first and second bases, each of the columnar beams enclosed in an elastic material so as to form a pod that is movable with respect to the main body portion, the pods terminating in bristle carrying surfaces;

a plurality of bristles extending from each of the bristle carrying surfaces of the pods in the first direction;

the columnar beams and the bases located along the longitudinal axis of the head, the pods and the bases spaced apart from one another so that the pods can move independently of one another and the bases; and wherein the bristle carrying surfaces and the first and second cleaning element carrying surfaces transversely extend the substantial entirety of the width of the head.

* * * * *